United States Patent [19]

Van Sloun

[11] Patent Number: 4,466,332

[45] Date of Patent: Aug. 21, 1984

[54] DISPERSING MINE DISPENSER

[75] Inventor: Peter H. Van Sloun, Hopkins, Minn.

[73] Assignee: Honeywell Inc., Minneapolis, Mich.

[21] Appl. No.: 394,086

[22] Filed: Jul. 1, 1982

[51] Int. Cl.[3] ..... F42B 13/42; F41F 5/02

[52] U.S. Cl. ..... 89/1.5 R; 102/505; 343/18 E

[58] Field of Search ..... 89/1.5 R, 1.5 F, 1.806, 89/1.816, 1.818, 1.5 E; 102/505; 343/18 E

[56] References Cited

U.S. PATENT DOCUMENTS 3,083,993 4/1963 Damm ..... 89/1.5 R X 3,500,409 3/1970 Cash ..... 343/18 E

FOREIGN PATENT DOCUMENTS 7507004 12/1975 Netherlands ..... 102/505

*Primary Examiner*—David H. Brown

*Attorney, Agent, or Firm*—George W. Field

[57] ABSTRACT

In combination: launching apparatus including a discharge tube having an open end and a closed end; a stack of bodies in end-to-end relation in the tube; a flexible tether extending in the tube from the outermost end of the stack past the innermost end thereof, the tether crossing the stack between each pair of the bodies; apparatus at the closed end of the tube for propelling the stack of bodies out of the tube at the open end; and apparatus securing one end of the tether to the launching apparatus in such a manner that the tether does not become taut until the stack has passed out of the tube.

4 Claims, 5 Drawing Figures

DISPERSING MINE DISPENSER

TECHNICAL FIELD

This invention relates to the field of munitions, and more particularly to means for dispensing mines in an irregular pattern.

BACKGROUND OF THE INVENTION

In the process of warfare it is occasionally desirable to interdict the movement of enemy vehicles, such as tanks, across particular areas. This is conventionally accomplished by laying land mines in the area in question, which are not visually detectable by the vehicle drivers, but respond destructively when a vehicle is detected close to them by means responsive to pressure or magnetic anomalies, for example.

Mines for this purpose can not be positioned individually at any acceptable rate of distribution, and they are constructed for distribution in groups from dischargers which may be mounted in land vehicles or in helicopters. Heretofore available mine laying equipment has the disadvantage that the mines ordinarily land in a substantially straight line, so that a vehicle which happens to be moving in a parallel line may pass undamaged through a field of mines, simply by moving between the lines.

BRIEF SUMMARY OF THE INVENTION

The present invention comprises means whereby a group of mines may be discharged at a single point in a single direction, and yet come to rest in a dispersed pattern which has no preferred line, so that the likelihood of a vehicle being able to traverse the interdicted area without damage is substantially eliminated.

Various advantages and features of novelty which characterize the invention are pointed out with particularity in the claims annexed hereto and forming a part hereof. However, for a better understanding of the invention, its advantages, and objects attained by its use, reference should be had to the drawing which forms a further part hereof, and to the accompanying descriptive matter, in which there is illustrated and described a preferred embodiment of the invention.

DESCRIPTION OF THE PREFERRED EMBODIMENT

Figure 1:
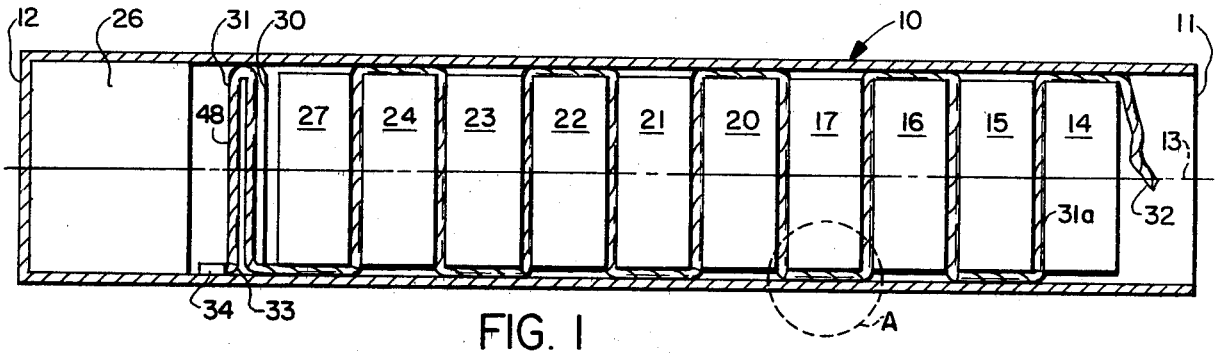
FIG. 1 is longitudinal section of a set of mines installed in a discharger for dispensing according to the invention.

Referring now to the drawing in detail, FIG. 1 shows a mine launcher comprising a discharge tube 10 having an open end 11 and a closed end 12. It must be understood that in a typical mine laying operation a bank of such launchers will be mounted in a helicopter or on a land vehicle, having the axes 13 of the launches aligned parallel. In a helicopter, the axes may be generally horizontal, while for a land vehicle the axes may slope upward to adjust for range; in each case the launchers extend laterally from the path of the vehicle.

Tube 10 is generally circular in cross-section, and contains a stack of land mines 14, 15, 16, 17, 20, 21, 22, 23, and 24 in end-to-end relation, mine 14 being the outermost and mine 24 being the innermost. The mines are propelled from the launcher as a group by an explosive charge 26 located at the closed end of the tube and fired by conventional means not shown. The explosive force is transmitted to the mines by an obturator, including a body 27 of plastic foam having a general shape and size of a mine, to which there may be secured a flexible sealing diaphragm 30.

A tether 31 extends through tube 10 from a first or outer end 32 to a second, or inner end, 33. The tether crosses the tube between each pair of mines, as at 31*a* between mines 14 and 15, for example. End 32 of tether 31 remains unattached: end 33 is attached to an energy absorbing tether block 34 presently to be described.

Figure 2:
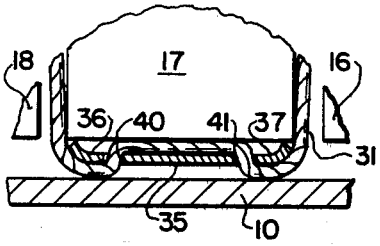
FIG. 2 is a fragmentary detail of the area defined in FIG. 1 by the broken line circle A.

In a preferred embodiment of the invention tether 31 comprises a flexible steel cable. In operation of the device a strong force is applied lengthwise of the cable, which might be sufficient to simply draw the cable through the spaces between the mines. To insure that this does not happen, there are provided a plurality of friction bars 35, one associated with each mine of the stack. FIG. 2 shows that friction bar 35 has a pair of curved ends 36 and 37 which contact the side of mine 17, and a pair of holes 40 and 41 spaced inwardly from the ends. Tether 31 passes between mines 16 and 17, passes inwardly through hole 41, rearwardly along the side of mine 17, outwardly through hole 40, and then across the space between mines 17 and 18. The sharp bends in the cable as it passes through holes 40 and 41 offer great resistance to lengthwise movement of the tether through the stack of mines, to such an extent that outer end 32 simply lies across the outer end of mine 14. Before being attached to block 34, tether 31 is given an amount of slack 48 at least equal to the length of tube 10.

Figure 3:
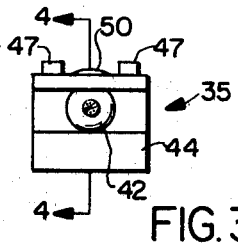
FIG. 3 is an end view of an energy absorptive tether block usable in the invention.
Figure 4:
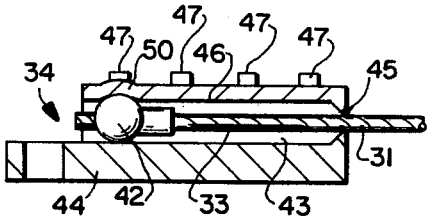
FIG. 4 is a sectional view along the line 4—4 of FIG. 3.

As shown in FIGS. 3 and 4, a swage ball 42 is swaged onto the end 33 of tether cable 31 and is received in a channel 43 in the base 44 of block 34. At one end 45 channel 43 may be reduced in diameter to pass tether 31, but not ball 42. Channel 43 is closed laterally by a plate 46 of deformable metal secured to base 44 by fasteners 47. The upper portion of block 44 as seen in FIGS. 3 and 4 is cut away somewhat, so that when plate 46 is tightened against base 44, ball 42 upsets the metal of plate 46 as seen at 50. Movement of cable 31 to the right can only be accomplished by extending the upset along the plate, which offers a considerable but predictable resistance, the resistance remaining constant as ball 42 moves.

OPERATION

The operation of the dispersing mine dispenser will now be explained. When the launcher has reached a desired site, explosive 26 is triggered, creating a powerful gas in the space closed by obturator 27, and the entire assembly of mines, obturator and tether is propelled out of tube 10, except that end 33 of the tether remains secured in tether block 34. The explosive charge 26 imparts a considerable momentum to the mass of mines, and when the slack 48 of the tether is all taken up, the result is the application of a force between the tether and block 34. Since the tether is prevented from simply moving through the stack, in the direction of its own length, by bars 35, the tether exerts strong lateral forces on the mines of the stack through the bars.

Figure 5:
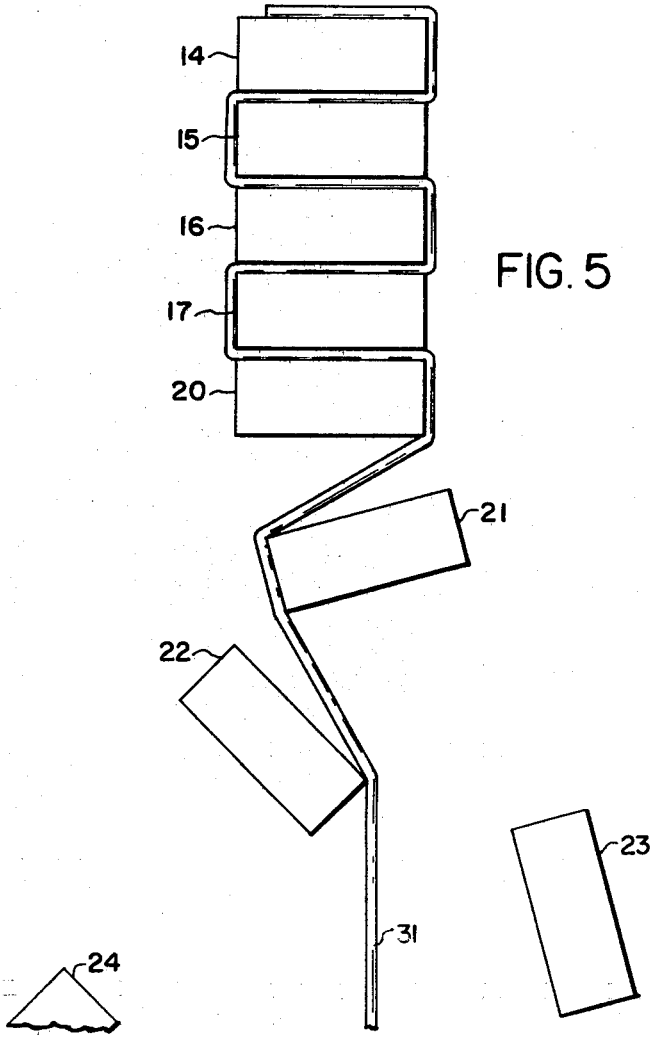
FIG. 5 is a diagrammatic view of the distribution process in progress.

FIG. 5 shows an early stage in the dispersion sequence. Obturator 27 has been discarded. Mine 24 has been dispersed to the left, mine 23 has been dispersed to the right, and mine 22 is being dispersed to the left. It is to be realized that mines retain their forward impetus, and that the lateral impetus supplied by tether 31 adds thereto vectorially. The inertia of the undispersed stack is still acting through tether 31 on ball 42, drawing it through channel 43 and upsetting plate 46. This arrangement corresponds roughly to the action of a spring, except that the force remains constant throughout the ball movement. A portion of the inertia of the stack is expended in giving lateral acceleration to the mines of the stack, and by the time ball 42 reaches end 45 of channel 43 the remaining force in tether 31 is not sufficient to break the tether. This gradually decreasing force results in gradually decreasing lateral accelerations of the mines, until eventually mine 14 receives practically no lateral acceleration and proceeds on its original course. The mines then reach the earth in a somewhat fan shaped distribution determined by the initial propulsion given by the explosive charge, and the lateral accelerations resulting as tether 31 straightens.

When the distribution is completed, tether 31 with bars 35 remains extending out of tube 20, and in most cases is simply discarded with the tube. It is is desired to avoid dangling cables, as in aircraft operation, channel 43 may be left open at end 45, so that ball 42 may draw free and release tether 31 from the discharger.

Under some circumstances, it may be desirable to substitute a tape for the cable as tether 31. If the tape is of significant width, its nautral friction with the ends and sides of the mines may make the provision of friction bars 35 unnecessary.

It may also be desirable under some circumstances to omit tether block 34 and substitute therefor, a small parachute fastened to end 33 of tether 31. The parachute will open after the assembly leaves the tube, and its greater drag coefficient than the mine stack will cause dispersal of the mines by tether 31, as previously described.

Numerous characteristics and advantages of the invention have been set forth in the foregoing description, together with details of the structure and function of the invention, and the novel features thereof are pointed out in the appended claims. The disclosure, however, is illustrative only, and changes may be made in detail, especially in matters of shape, size, and arrangement of parts, within the principle of the invention, to the full extent indicated by the broad general meaning of the terms in which the appended claims are expressed.

I claim:

1. In combination:

launching means including a discharge tube having an open end and a closed end;

a stack of bodies in end-to-end relation in said tube;

a flexible tether extending in said tube from the outermost end of said stack past the innermost end thereof, said tether crossing said stack between each pair of said bodies and having a free outer end;

means at the closed end of said tube for propelling said stack of bodies out of said tube at said open end;

and means securing the inmost end of said tether to said launching means in such a manner that said tether does not become taut until said stack has passed out of said tube.

2. The combination of claim 1 in which the last named means comprises an energy-absorbing tether block and said one end of said tether remains attached thereto.

3. The combination of claim 1 including means resisting lengthwise movement of said tether through said stack with respect to said bodies.

4. The combination of 3 in which said tether is a cable, and in which the last named means includes friction bars transversed by said cable for engagement with the sides of said bodies.

* * * * *